United States Patent [19]

Jones

[11] 4,141,092

[45] Feb. 27, 1979

[54] DUAL-FLUSH, TANK-ACTUATING DEVICE

[76] Inventor: Ian R. Jones, 30817 Via Rivera, Rancho Palos Verdes, Calif. 90274

[21] Appl. No.: 806,078

[22] Filed: Jun. 13, 1977

[51] Int. Cl.[2] ..... E03D 1/22; E03D 5/02

[52] U.S. Cl. ..... 4/324; 4/410; 4/413

[58] Field of Search ..... 4/34, 37, 44, 52, 56, 4/57 P, 67 R, 67 A, 326, 324, 325, 345, 346, 378, 405, 410, 411, 413; 74/548

[56] References Cited

U.S. PATENT DOCUMENTS

| | | | |
|---|---|---|---|
| 1,563,729 | 12/1925 | Dominquez | 4/67 R |
| 2,963,710 | 12/1960 | Carter | 4/67 R |
| 3,234,566 | 2/1966 | Rupp | 4/67 R |
| 3,561,015 | 2/1971 | Moore | 4/67 R |
| 3,777,316 | 12/1973 | Coetzee | 4/67 R X |

*Primary Examiner*—Stuart S. Levy
*Attorney, Agent, or Firm*—Francis X. LoJacono

[57] ABSTRACT

A dual-actuating flush device for selectively allowing a partial or a full quantity of water to be discharged from the toilet-water tank into the associated toilet bowl; wherein the tank includes independent partial and full flush valve mechanisms to provide conservation of water, each flush valve being arranged at a different water level within the tank, and operably connected to the dual-actuating device which comprises a handle that is operated only in a downward movement for both the partial and the full flush. For a partial flush, which operates the upper level valve, the handle is moved downwardly in a normal manner, with a limited stroke. To provide for a full flush, the handle is pushed inwardly and downwardly, allowing a selective pin to travel in a large elongated groove, thereby extending the downward stroke of the handle, and thus operating the second and lower disposed flush valve, allowing a larger quantity of water to be drained therefrom.

6 Claims, 13 Drawing Figures

FIG. 1
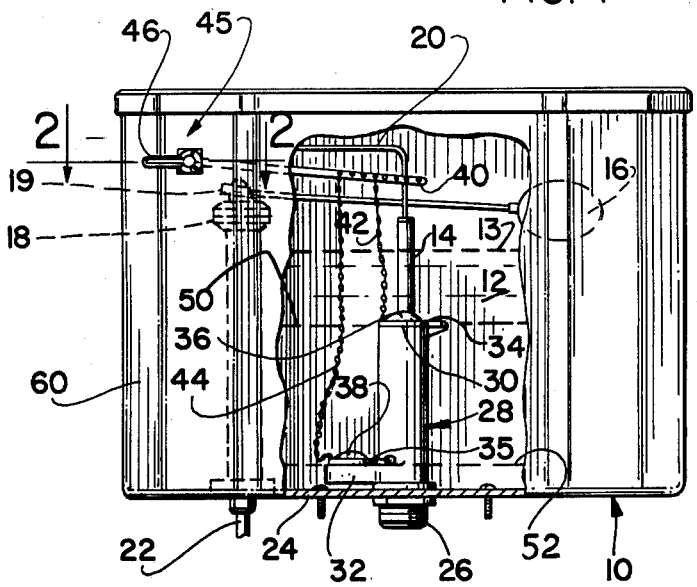
FIG. 5
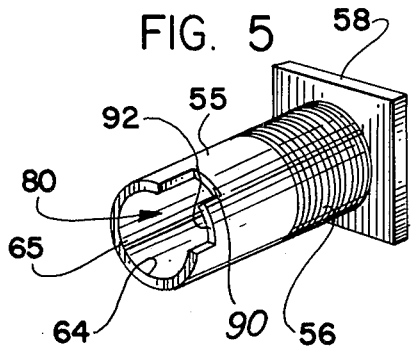
FIG. 4
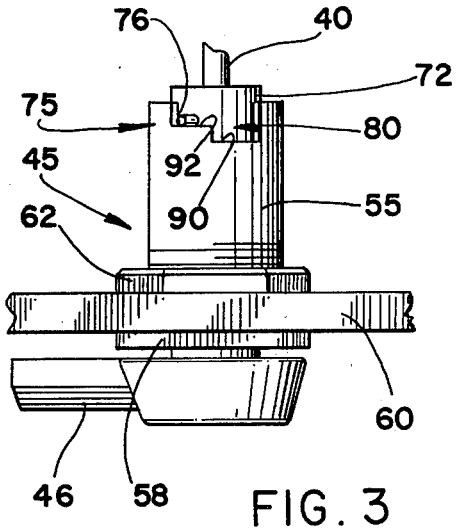
FIG. 2
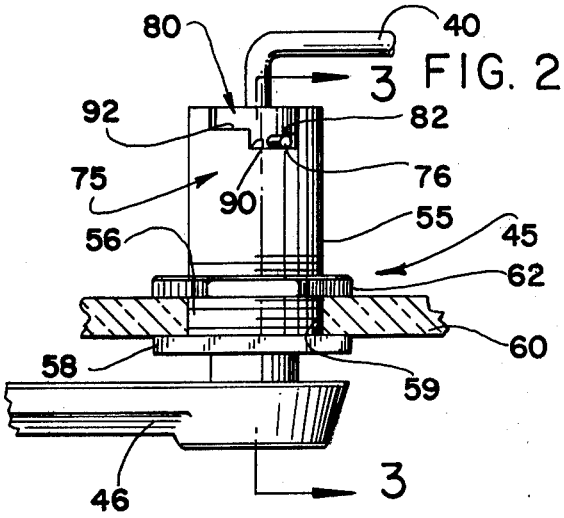
FIG. 3
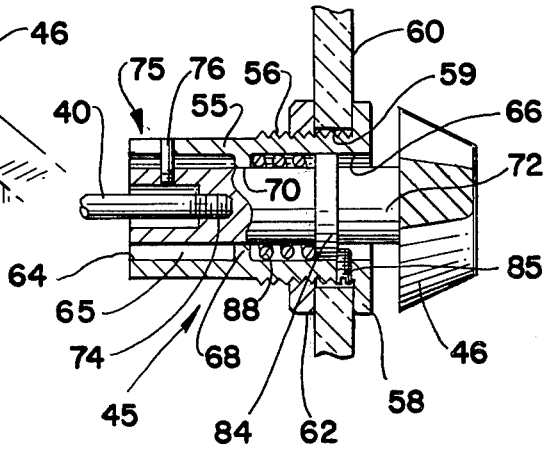
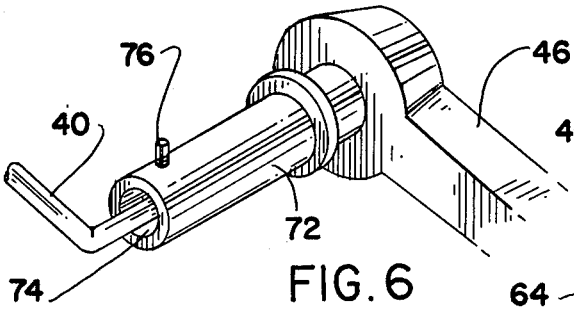
FIG. 6

DUAL-FLUSH, TANK-ACTUATING DEVICE

BACKGROUND OF THE INVENTION

1. Field of the Invention

This invention relates to a mechanism for operating a flush valve of a toilet tank and, more particularly, to an actuating device that will operate a dual-flush-valve apparatus to control the amount of water to be discharged with respect to liquid waste or solid waste.

2. Description of the Prior Art

As is well known in the art, several problems and difficulties are encountered in providing suitable means for flushing controlled amounts of water from a toilet-water tank, also known as a water closet.

Many types of dual-flush-valve mechanisms are used and known. Each of these devices has various types of actuating means which control their release. However, these devices have features that either restrict their use, or are complicated to operate and expensive to maintain. One such dual-flush tank valve is disclosed in U.S. Pat. No. 3,909,856. In this unit, there is a very unnatural actuating-arm system, which makes it necessary to operate the handle in an abnormal manner; that is, it must be moved rearwardly or forwardly to correspond to operating the upper or lower flush valve.

The water-conservation flush tank as shown in U.S. Pat. No. 3,763,501 also includes two separate valve seats that are formed in the flush tank and operated by individual actuating mechanisms. This device and those shown in U.S. Pat. Nos. 3,945,057; 3,981,029; 3,918,105; and 3,787,902 disclose other arrangements of dual flushing.

Despite the above-referenced patents and other known attempts at providing water conservation in the flushing of toilets, the complexities of installation and operation, as well as the high costs, have apparently slowed the universal adoption of these devices. However, it is imperative that a successful means be devised to conserve our water supplies.

SUMMARY OF THE INVENTION

The present invention comprises a dual-actuating mechanism that allows for simple control of partial and full flushes of water in toilets having conventional toilet-storage tanks, wherein the tanks include a dual-flush valve and respective seats. The actuating device as herein disclosed allows the selection of either a partial or a full flush — depending on the liquid waste or the solid waste to be discharged — by actuating a handle in the well-established downward manner, wherein the handle movement is limited to a short-stroke movement, thus operating the upper dual valve for a light or small amount of water flow to be discharged. In order to provide a full or heavy flush, the handle is only forced inwardly, thus disengaging a limiting pin and allowing a longer stroke of the handle. Therefore, only one lever arm is required, as is the case with single flush units.

Because of the particular arrangements of the various actuating mechanisms herein disclosed, no special tools or complicated elements are necessary. Even the very young can operate the present device without flushing the wrong amount of water.

OBJECTS AND ADVANTAGES OF THE INVENTION

The present invention has for an important object a provision wherein the handle of the actuating mechanism can only be operated in a normal downward stroke having a short controlled stroke for light flushes and a longer controlled downward stroke for a full or heavy flush.

It is another important object of the invention to provide a dual-actuating device for toilet discharge that will drastically reduce or eliminate unnecessary consumption of water when flushing liquid waste from toilets.

It is still another object of the invention to provide a dual-actuating device for toilet flush tanks that prevents accidental and wasteful flushing of an unnecessary full tank of water.

It is a further object of the invention to provide a device of the character that is adaptable to all existing water-storage tanks, whereby the average homeowner can install the present device without special tools — regardless of the age, make or model of a water tank.

Still another object of the invention is to provide a device of this character that is easy to service and maintain.

A still further object of the invention of this type is to provide an actuating means that is relatively inexpensive to manufacture, and is also simple and rugged in construction.

It is still a further object of the invention to provide a device of this character that has relatively few operating parts.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

Referring more particularly to the drawings, which are for illustrative purposes only:

FIG. 1 is a front-elevational view of a toilet tank, with a portion thereof broken away to illustrate the arrangement of the present invention;

FIG. 2 is an enlarged, cross-sectional view taken along the line 2—2 of FIG. 1, wherein the actuator is shown in the short-stroke mode;

FIG. 3 is a cross-sectional view taken substantially along line 3—3 of FIG. 2;

FIG. 4 is a plan view of the actuator shown in the full-flush position;

FIG. 5 is a perspective view of the actuator support housing;

FIG. 6 is a perspective view of the actuator lever shaft having the handle attached thereto;

DESCRIPTION OF THE PREFERRED EMBODIMENT

Figure 7:
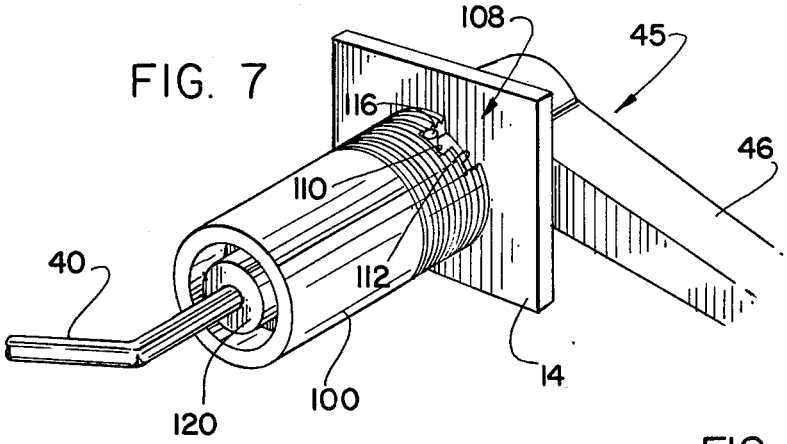
FIG. 7 is a perspective view of the present invention shown in an alternative arrangement, wherein the handle is designed to be pulled outwardly when a full flush is required.

Referring now to the embodiment shown in FIGS. 1 through 6, and more particularly to FIG. 1, there is shown a typical toilet-water tank, also known as a water closet, generally indicated at 10. The water tank 10 defines a storage compartment 12 wherein water is generally stored at a level 13 just below the overflow tube 14, level 13 being determined by a suitable float 16 connected to the water-inlet assembly 18 having a shut-off valve 19 and refill tube 20, as is well known in the art — and thus no further details thereof are felt to be necessary.

Thus, water enters through inlet line 22 affixed to bottom wall 24 of said tank. The bottom wall 24 includes a typical hole to receive outlet conduit 26 which cooperates with the dual-flush valve system, generally indicated at 28. Said dual-flush valve 28 can be any suitable make or design, wherein an upper-discharge valve unit 30 is provided along with a lower-discharge valve unit 32. The valve units include valve seats 34 and 35, respectively, and upper and lower flapper valves 36 and 38, respectively. The upper valve 36 is connected to a single actuator-lever arm 40 by a suitable connecting means, shown herein as a short flexible chain 42, wherein the lower valve 38 is connected to the same lever arm 40 by flexible chain 44.

Thus, when lever arm 40 is selectively actuated upwardly in a normal manner by the dual-flush actuating device, indicated generally at 45, valve flappers 36 and 38 will be selectively opened to allow discharge of water. The selective operation of actuating device 45 will hereinafter be described in detail. First, however, it should be noted that said actuating device 45 has a normal short-stroke operation when handle 46 is rotated downwardly, whereby lever arm 40 raises just far enough to lift flapper valve 36. The lower valve is not affected thereby, due to the extra length and play provided in chain 44.

Accordingly, when flapper valve 36 is opened, water is discharged therethrough, wherein the water level 13 drops to a first discharged water level 50. Thus, when actuating device 45 is operated to provide a longer stroke for a full flush, level arm 40 raises higher, whereby flapper valve 38 will open. This then allows water level 13 to drop to a second full-flush level 52, whereby water between level 50 and 52 discharges through valve 32.

Referring now to the detail of the embodiment of the present invention, there is shown in FIGS. 2 through 6 the dual-flush, tank-actuating device 45 comprising a bushing housing 55 having external threads 56 and an enlarged head member 58 disposed at one end thereof, wherein the bushing portion thereof is mounted within an opening 59 formed in the front wall 60 of tank 10. A nut member 62 is threadably received on bushing housing 55, thus clamping said housing to said wall 60 between nut 62 and head member 58. Bore 64 is disposed longitudinally through housing 55 and is divided into two sections — rear section 65 and forward section 66 — the front section terminating with head member 58.

The sections are formed by an annular flange member 68, as seen in FIG. 3. Thus flange 68 defines an annular aperture 70 having a diameter to receive an actuating-shaft member 72 that has handle 46 affixed to the outer end thereof. Shaft 72 includes a bore 74 adapted to receive one end of lever arm 40 therein, wherein said arm is affixed thereto so as to move when handle 46 is moved.

However, the rotating movement of the handle 46 and shaft 72 is controlled by the limiting means, generally indicated at 75, wherein said limiting means comprises a stop means, indicated as pin 76, which is affixed to the free end of shaft 72 and a bayonet slot 80 formed in the free end of housing 55 (See FIG. 5). Said slot 80 is disposed in rear bore section 65 so as to receive pin 76 therein.

As is well known in the art, lever arm and its attached chains will normally force handle 46 to a horizontal position; and, thus, handle 46 must be forced downwardly to lift lever arm 40 when valves 36 and 38 are to be operated. Hence, pin 76 rests or abuts against edge 82 when both valves are in a normally closed mode and the water is at its highest level 13. In this particular arrangement, shaft 72 includes an annular lip 84 positioned thereon so as to slidably receive in a forward bore section 66 of housing 55. Various means can be employed to prevent shaft 72 from being removed from housing 55 if needed; and one such means is indicated by set pin 85. Interdisposed between annular flange member 68 and annular lip member 84 of shaft 72 is a biasing spring 88 which applies a constant outward force on handle 46. This, then, will restrict the movement of pin 76; that is, pin 76 can only travel the distance defined by lower groove 90 of bayonet slot 80, as seen in FIG. 2. Thus, the handle is restricted to a short-stroke movement, allowing only the upper flapper valve 36 to open.

However, when a full flush is necessary, handle 46 is pushed inwardly against spring 88, allowing pin 76 to override the lower groove 90 and move into upper groove 92, thereby providing a longer stroke and allowing chain 44 to be activated — thus opening lower flapper valve 38, at which time the water level will discharge to a point at 52.

Hence, it can be readily understood that flushing of the tank is very simply controlled; and the handle can still be operated in the normal established downward stroke.

Referring now to a second embodiment shown in FIGS. 7 through 10, there is shown a bushing housing 100 also provided with a forward bore section 102 and a rear bore section 104 divided by an annular flange member 106, wherein the limiting means 108 includes a bayonet slot having a short-stroke groove 110 and a long-stroke groove 112, said bayonet slot being formed in housing 100 adjacent the head member 114. Stop means, indicated by pin 116, is positioned on a shaft 120 so as to be received in grooves 110 and 112.

Figure 8:
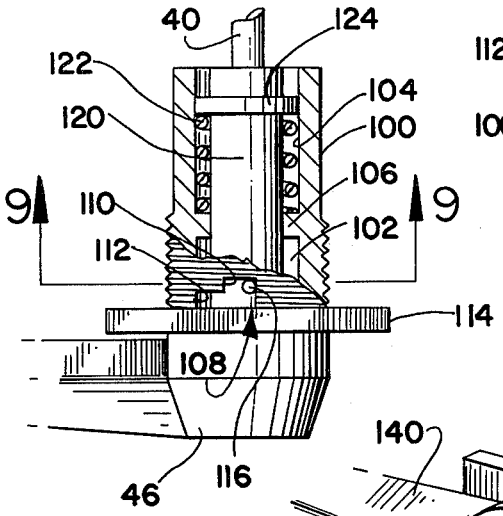
FIG. 8 is a top plan view thereof, with a portion thereof broken away to show the internal elements therein.

However, in this arrangement, the biasing means shown as spring 122 is located in the rear bore section 104, as illustrated in FIG. 8. Spring 122 is interposed between annular flange 106 and the annular lip member 124 formed adjacent the free end of shaft 120.

Accordingly, as handle 46 is rotated in the normal manner, pin 116 is restricted in its movement within the short-stroke groove 110, thereby limiting the movement of lever arm 40, as previously described herein. However, due to the arrangement of the limiting means 108 with respect to the position of the biasing means 122, handle 46 must be pulled outwardly against the force of spring 122, in order to allow pin 116 to be received in the long-stroke groove 112, whereby a full flush is accomplished.

Figure 9:
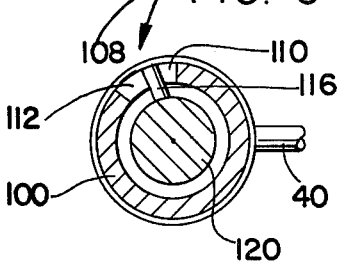
FIG. 9 is a cross-sectional view taken along line 9—9 of FIG. 8, wherein the actuator is in a short-stroke, partial-discharge position.
Figure 10:
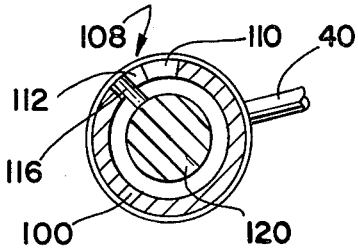
FIG. 10 is a similar cross-sectional view thereof, showing the actuator in a full-discharge position.

FIG. 9 illustrates the position of pin 116 for a short-stroke, partial flush; and FIG. 10 shows pin 116 positioned in a long-stroke, full flush.

Figure 11:
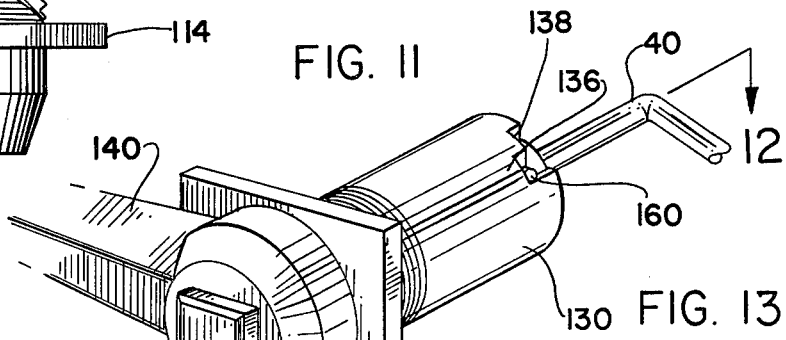
FIG. 11 is a perspective view of another alternative arrangement of the present invention.
Figure 12:
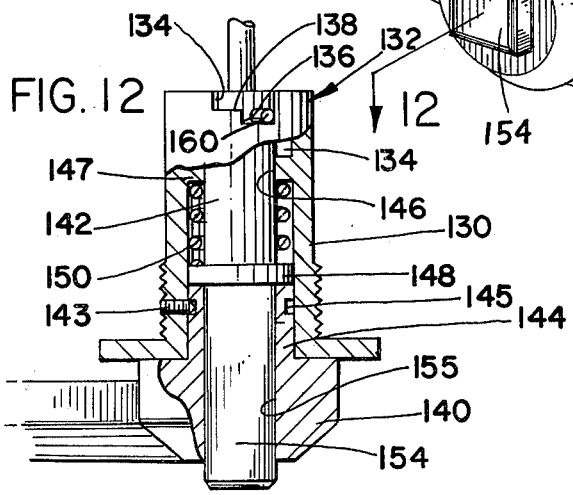
FIG. 12 is a cross-sectional view taken along line 12—12 of FIG. 11.
Figure 13:
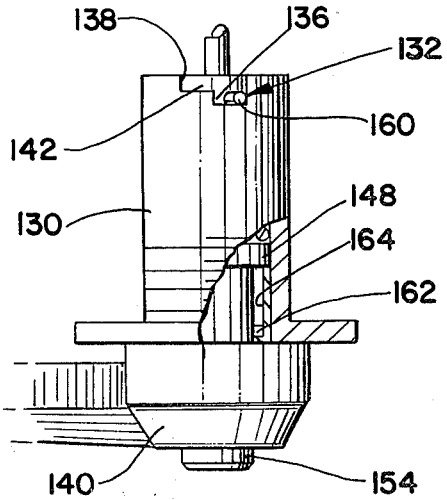
FIG. 13 is a plan view, with a portion thereof broken away showing a key-support means.

FIGS. 11, 12, and 13 illustrate another embodiment comprising a bushing housing 130, wherein the limiting means 132 is positioned adjacent the rear bore section 134, described in the first embodiment, having a short-stroke and a long-stroke groove 136 and 138, respectively. However, in this arrangement, the handle 140 is not affixed to the shaft 142. Handle 140 includes a neck member 144 adapted to be received in housing 130 and secured therein by a securing means, such as set screw 143 and annular channel 145, which permits handle 136 to rotate therein, without longitudinal movement.

Shaft 140 is formed having one end cylindrical so as to be slidably received through opening 146 defined by annular flange 147. Intermediate the ends of shaft 142 there is integrally positioned an annular lip 148, whereby biasing spring 150 is disposed between flange 147 and annular lip 148, thus holding shaft 142 in an outwardly extended position, wherein the opposite end 154 of the shaft is slidably received through a longitudinal bore 155 of the handle 136. The bore 155 and the extended end 154 of shaft 142 are each provided with at least one mating flat surface or side formed along their corresponding longitudinal lengths. However, in this arrangement, the extended end 154 is squared to match the square-shaped bore 155; and, thus, shaft 142 will rotate with handle 140.

Accordingly, when handle 140 is rotated, pin 160 will move in the first groove 136, allowing a restricted flow of water to be discharged. When shaft 142 is pushed inwardly, pin 160 will be received in the long-stroke groove 138 as handle 140 is rotated, allowing for a full flush of water.

FIG. 13 is a view of an actuating device similar to that of FIG. 12, wherein only the securing means is differently arranged. That is, the extended end 154 is also cylindrical in shape and has a key 162 disposed along the cylindrical surface of said end 154, the key being slidably received in a keyway 164 formed in the mating longitudinal surface of said bore, whereby shaft 142 is permitted to slide longitudinally, but held for rotation with handle 140.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A dual-actuating, flush device for toilets having a dual-discharge-valve mechanism, whereby a partial or a full flush is selected by the operation of said device, wherein the device comprises:

a housing arranged to be mounted to said toilet having a forward bore and rear bore disposed therein;

an annular flange member disposed between said forward and rear bores, said flange defining an aperture therein;

a slidable shaft positioned in said forward and rear bores for longitudinal movement therein;

a handle mounted to one end of said shaft;

a lever arm affixed to one end of said shaft opposite that of said handle;

limiting means arranged between said shaft and said housing for selective movement of said lever arm;

wherein said limiting means comprises:

a bayonet slot member formed in said housing; and a pin mounted to said shaft and operably received in said bayonet slot member, to selectively control the movement of said lever arm which is operably attached to said dual-discharge valve mechanism; and wherein said bayonet slot member includes:

a short-stroke groove, whereby movement of said handle is limited and wherein a partial flush of water is allowed to be discharged; and a long-stroke groove, whereby said pin is arranged to be received in said long-stroke groove by longitudinal movement of said shaft, allowing a full flush of water to be discharged;

biasing means disposed in one of said bores and arranged to engage said shaft;

wherein said biasing means comprises:

a spring member;

an annular lip member disposed on said shaft wherein said spring member is positioned between said annular lip member and said annular flange members, whereby said pin mounted to said shaft is biased in engagement with said short-stroke groove; and wherein said shaft must be moved longitudinally against the force of said spring member, to allow said pin to be received in said long-stroke groove.

2. A dual-actuating, flush device as recited in claim 1, wherein said limiting means is positioned adjacent and in said rear bore; and wherein said spring member and said annular lip member of said shaft are positioned in said forward bore, whereby said handle is forced inwardly, to allow said pin to be received in said long-stroke groove.

3. A dual-actuating, flush device as recited in claim 2, wherein said shaft is slidably mounted to said handle; and wherein said shaft includes means to allow said shaft to rotate with said handle.

4. A dual-actuating, flush device as recited in claim 3, wherein said means to allow said shaft to rotate with said handle comprises:

a longitudinal bore disposed in said handle, said bore having at least one flat side disposed along the surface of said bore therein; and said shaft having an extended end member projecting from said handle, and said shaft including at least one longitudinal flat side for mating engagement with said flat side of said bore of said handle, thereby allowing longitudinal movement of said shaft separate from said handle and providing rotational movement with said handle.

5. A dual-actuating, flush device as recited in claim 3, wherein said means to allow said shaft to rotate with said handle comprises:

a longitudinal bore disposed in said handle;

a cylindrical extended end member formed as part of said shaft and projecting outwardly from said bore of said handle;

a key affixed along the length of said extended end member; and a keyway formed in the longitudinal surface of said bore of said handle, whereby said shaft is longitudinally slidable in said bore handle, and held to rotate with said handle.

6. A dual-actuating, flush device as recited in claim 1, wherein said limiting means is positioned adjacent and in said forward bore; and wherein said spring member and said annular lip member of said shaft are positioned in said rear bore of said housing, whereby said handle is pulled outwardly to allow said pin to be received in said long-stroke groove.

* * * * *